US006216401B1

(12) United States Patent
Emek

(10) Patent No.: US 6,216,401 B1
(45) Date of Patent: Apr. 17, 2001

(54) BLAST RESISTANT WINDOW FRAMEWORK AND ELEMENTS THEREOF

(75) Inventor: Mordechay Emek, Lod (IL)

(73) Assignee: Arpal Aluminum Ltd., Lod (IL)

( * ) Notice: Subject to any disclaimer, the term of this patent is extended or adjusted under 35 U.S.C. 154(b) by 0 days.

(21) Appl. No.: 09/265,374

(22) Filed: Mar. 10, 1999

(30) Foreign Application Priority Data

Apr. 7, 1998 (IL) ..... 123980

(51) Int. Cl.[7] ..... E06B 3/01; E06B 1/14

(52) U.S. Cl. ..... 52/204.5; 52/1; 52/203; 52/208; 52/171.1; 52/204.62; 52/204.72; 52/463; 52/770; 49/62; 49/9; 49/322; 49/507

(58) Field of Search ..... 52/1, 202, 463, 52/204.5, 171.1, 203, 204.6, 204.62, 204.72, 208, 770; 49/181, 446, 176, 445, 62, 63, 463, 489.1, 495.1, 496.1, 322, 507, 9

(56) References Cited

U.S. PATENT DOCUMENTS 4,027,443 * 6/1977 Briggs ..... 52/202
4,630,411 12/1986 Salzer .
4,896,613 1/1990 Salzer .
5,027,557 * 7/1991 May ..... 49/181
5,636,484 * 6/1997 DeBlock ..... 52/204.5
5,765,325 * 6/1998 DeBlock ..... 52/204.5

FOREIGN PATENT DOCUMENTS 2705710 12/1994 (FR) .
103168 9/1992 (IL) .
115840 11/1995 (IL) .

* cited by examiner

*Primary Examiner*—Carl D. Friedman
*Assistant Examiner*—Yvonne M. Horton
(74) *Attorney, Agent, or Firm*—Browdy and Neimark

(57) ABSTRACT

There is described a profiled sash section for a window sash holding a window pane and intended for being installed in an outer frame of a blast resistant window. The sash section includes a main member enabling inter-engagement between the profiled sash member and the outer frame; a window pane holding member for accommodating and securing an end portion of said window pane in the profiled sash member, and a reinforcing member designed to support the end portion of the window pane and to transmit blast pressure, if incidentally applied to the window pane, to the main member. For at least partially absorbing blast pressure energy applied to the window pane, the sash section is provided with damping means for deforming up to a predetermined limit. Also described is a blast-resistant framework for a casement window, including the window sash assembled from the mentioned profiled sash sections and adapted for rigidly and air-tightly securing the window pane in the holders of the profiled sash members.

10 Claims, 7 Drawing Sheets

BLAST RESISTANT WINDOW FRAMEWORK AND ELEMENTS THEREOF

FIELD OF THE INVENTION

This invention relates to a blast resistant framework for a window, preferably for a casement window.

BACKGROUND OF THE INVENTION

The casement window referred to in the present description usually comprises a rectangular (sometimes a polygonal, arched or the like) framework consisting of a frame anchored within an opening in a wall and a sash swingably mounted thereon with locking means preventing unintended opening of the sash.

IL Patent 115840 to Arpal Aluminium Ltd. describes an adjustable casement window suitable for use as a blast resistant framework illustrated in FIGS. 1 to 3 which are indicated as Prior Art. A rectangular framework 2 for a windowpane 4 is mounted within an opening in a wall 6. The framework comprises an outer frame 8 typically made of steel and anchored within a corresponding rectangular aperture formed in the wall 6 by a portion 11 cast within the wall and by other suitable anchors (not shown), as known per se.

A jamb frame 12 is mounted within the outer frame 8 and consists of an upper frame head 14, a lower frame sill 16, a side shutting jamb 18 and a side hinging jamb 20.

The framework 2 further comprises a window sash 22, which consists of a profiled top rail 24, a bottom rail 26, a shutting stile 28 and a hinging stile 30. The window sash 22 is pivotally mounted with respect to the jamb frame 12 by means of hinges 32, secured respectively to the hinging jamb 20 and the hinging stile 30. The jamb frame 12 and the window sash 22 are typically made of a light metal such as aluminum.

The profiles of the vertical sash members 28 and 30 and the profiles of the horizontal sash members 24 and 26 are respectively formed with inwardly directed pairs of reinforcing flanges 34 and 36 designed to receive the end portion of the window pane 4. These profiles are also provided with suitable seals 38 and 40 for preventing egress or ingress of air, noxious gases, dust and water. The window sash 22 is lockable within the jamb frame 12 by means of a rotary handle 42 mounted on the shutting stile 28 and activating a locking mechanism as known per se, the constituent parts of which being generally and collectively designated as 44 in FIG. 3.

Locking mechanisms which are in use in the casement windows usually comprise upright (and sometimes also horizontal) sliding carrier members which are activated by a rotary handle and, in turn, displace a number of associated locking elements to bring them into their locked state. A blast-resistant casement window with such a locking system is described, for example, in IL Patent 103168 to Arpal Aluminium Ltd., and is effective against distortion and/or detachment with blasts corresponding to one atmosphere pressure (1 Bar=14.2 PSI). Experiments have shown that the above-described frameworks may appear to be ineffective against blasts creating pressures higher than those mentioned above. It has been noticed, that the described air-tight frameworks loose their properties due to bending deformations which appear in vertical and horizontal sash members when blast pressure is momentarily applied to the window pane. Such deformations may cause unlocking of some locking elements, consequent weakening of the lock and sometimes result in collapsing of the window pane into the interior of the shelter or room.

SUMMARY OF THE INVENTION

It is therefore an object of the present invention to provide a construction of a sash section for holding a window pane, being capable of effectively withstanding blast pressure if incidentally applied to the windowpane. A second object of the invention is a framework for a window comprising the inventive sash sections.

The above object can be achieved by providing a profiled sash section for a window sash holding a window pane and intended for being installed in an outer frame of a blast resistant window, said sash section comprising:

- a main member enabling inter-engagement between the profiled sash member and the outer fame;
- a window pane holding member for accommodating and securing an end portion of said window pane in said sash profiled member;
- a reinforcing member designed to support the end portion of the window pane and to transmit blast pressure, if incidentally applied to the window pane, to the main member;

said sash section being characterized in that it includes damping means for deforming up to a predetermined limit for at least partially absorbing blast pressure energy applied to the window pane.

In other words, the function of the damping means is to protect the basic structure of the profiled sash section and, consequently, of the window sash from being dangerously deformed by the blast pressure impact.

Preferably, the damping means are profiled, i.e. manufactured in one process with the sash section. However, said damping means may be produced separately (for example by molding) and then incorporated in the sash section.

It should be mentioned, that the inventive sash section may either be constituted by one integral profiled body, or be composed of at least two profiled inter-engaged segments.

The profiled sash section can be selected from a non-exhausting list comprising a hinging stile, a shutting stile, a top rail and a bottom rail. When installing the assembled window sash in the outer frame, said profiled sash sections respectively inter-engage and cooperate with a side hinging jamb, a side shutting jamb, a lower frame sill and an upper frame head.

The main member of the profiled sash section may constitute either a bar-like or tubular body; said main member being adapted for accommodating, at least on one of its surfaces, locking elements, hinges and the like.

Usually, said reinforcing member fills a corner formed between said main member and a plane of the window pane. Preferably, the reinforcing member forms a tubular body being substantially rectangular or trapezoidal in its cross-section.

According to one particular embodiment of the profiled sash member, said reinforcing member is an integral part of said main member which form together a tubular body which may have a cross-section in the form of a rectangle or another polygonal shape.

In accordance with one embodiment of the invention, said damping means comprise at least one damping connector provided between at least one of the following three pairs: the reinforcing member and the window pane holding member, the reinforcing member and the main member, the main member and the window pane holding member.

The damping means in general and the damping connector in particular may constitute a metal piece, bendable if excessive pressure is applied to the window pane. Such a damping connector may either form an integral part of the sash member, or be constituted by a damping insert.

Alternatively, the damping means or the damping connector may be shaped as a metal piece weakened at its particular portion and thus exposed for being deformed and/or broken by the blast pressure energy, thereby partially absorbing thereof.

In a particular case, the damping means may constitute at least one weakened element of said reinforcing member or said main member.

In yet a further embodiment, the damping means may comprise at least one male-female coupling unit in a non-engaged or partially engaged state, wherein elements thereof are connected, for example, to the window pane holding member and the reinforcing member, respectively; the unit being snap-fittingly engageable only when the incidental blast pressure is applied to the window pane.

In accordance with the second aspect of the invention, there is also provided a blast-resistant framework for a window, the framework comprising a window sash assembled from the sash members as defined above; the window sash being adapted for rigidly and air-tightly securing the window pane in the holding members of said sash members.

BRIEF DESCRIPTION OF THE DRAWINGS

In order to understand the invention, one prior art construction is shown in FIGS. 1 to 3.

Figure 4:
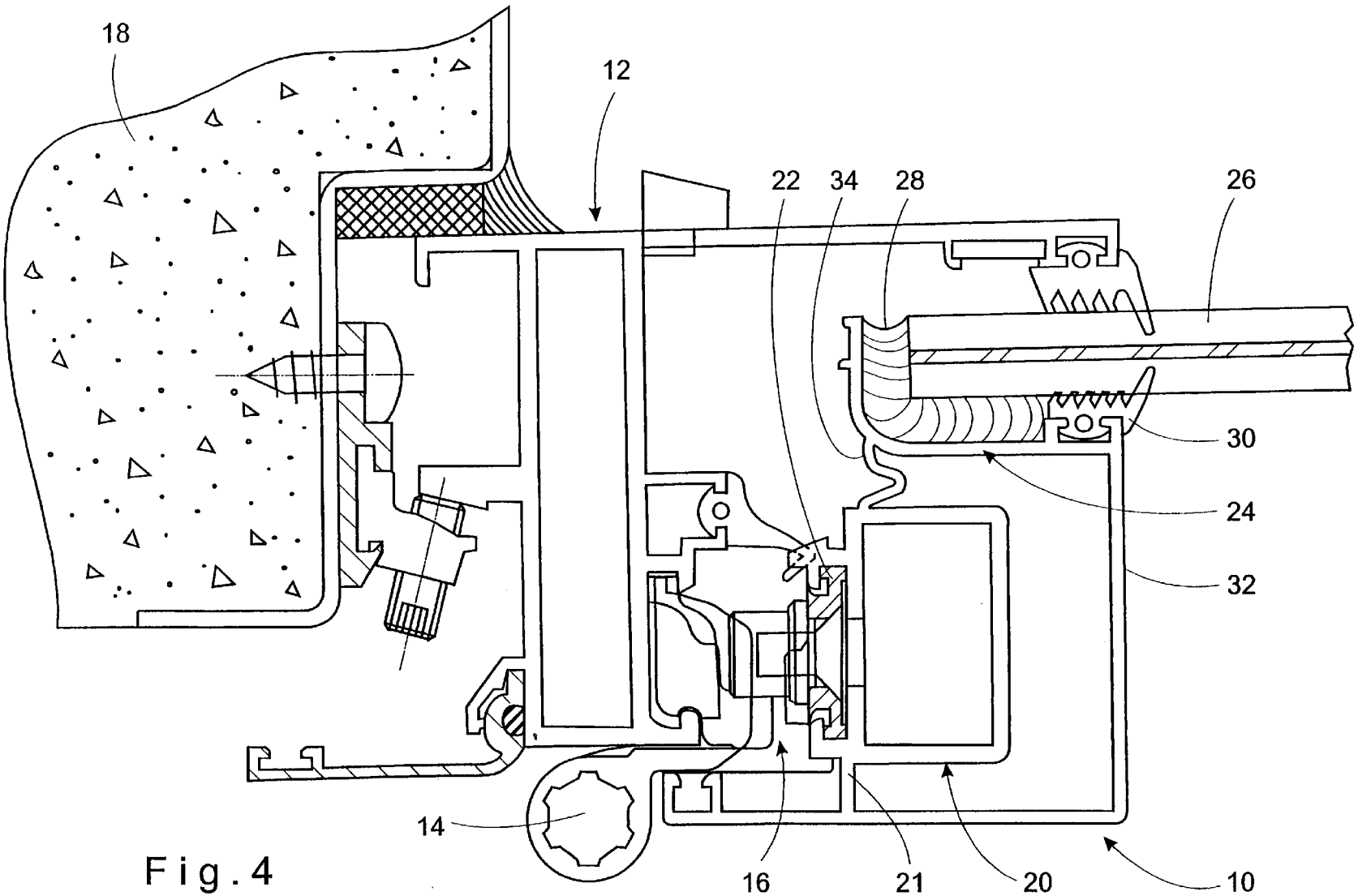

To see how the invention may be carried out in practice, preferred embodiments will be described, by way of non-limiting examples only, with reference to the accompanying drawings, in which:

FIG. 4 is a cross-section of one embodiment of the profiled sash member according to the invention, being engaged with a corresponding element of an outer window framework.

Figure 5:
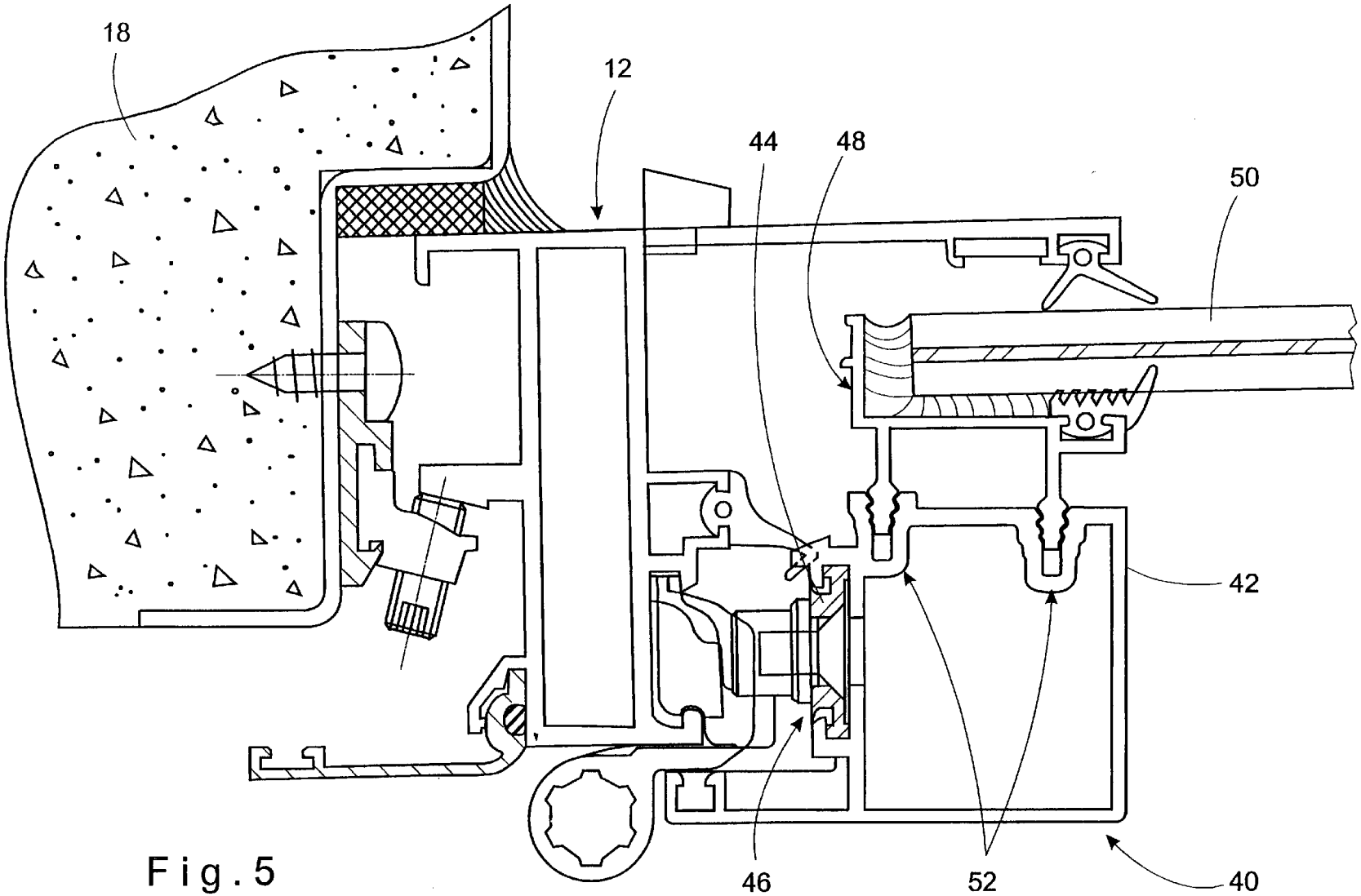

FIG. 5 is a cross-sectional view of another embodiment of the inventive profiled sash member.

Figure 6:
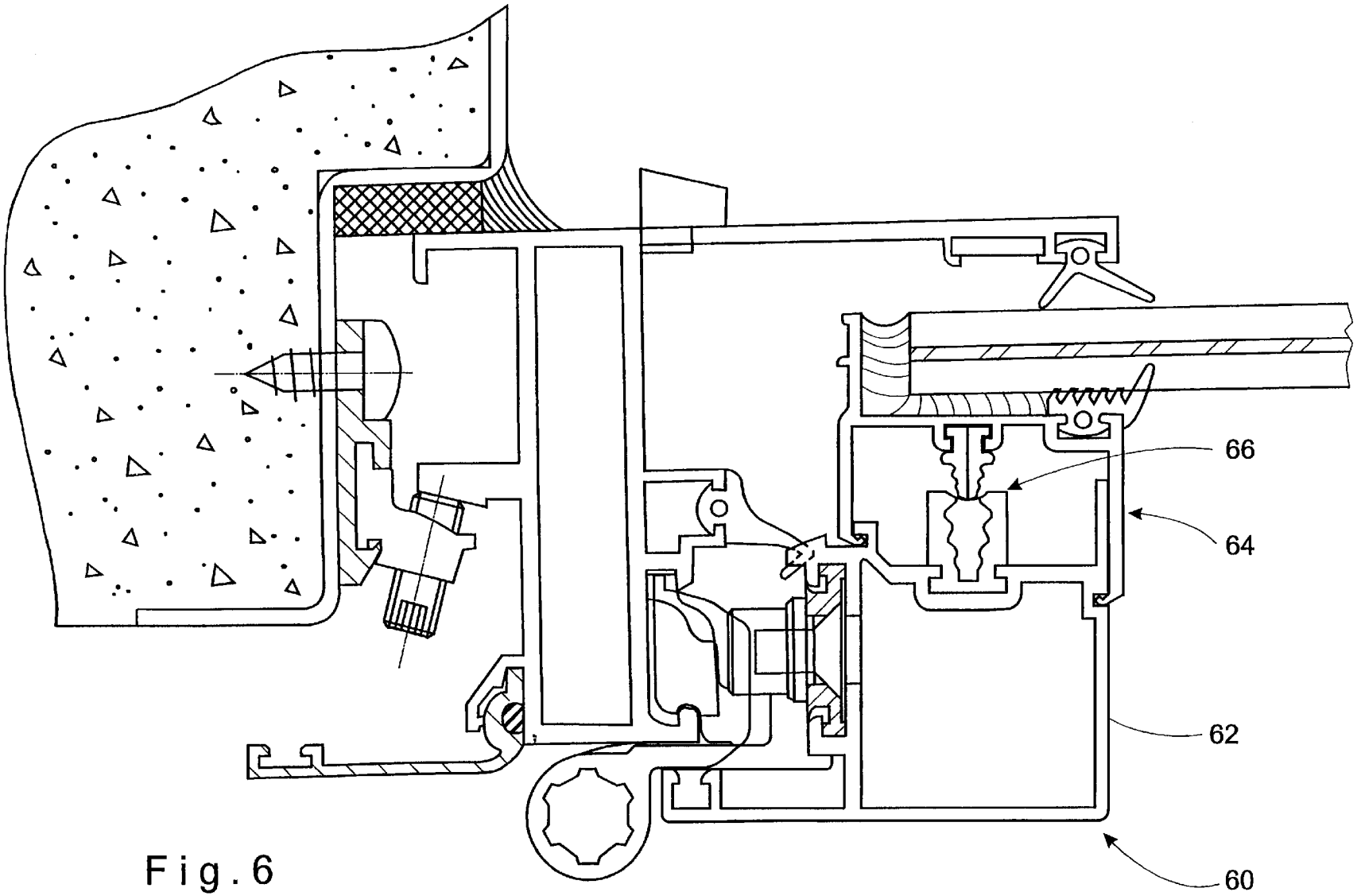

FIG. 6 is a cross-sectional view of a further embodiment of the profiled sash member according to the invention.

Figure 7:
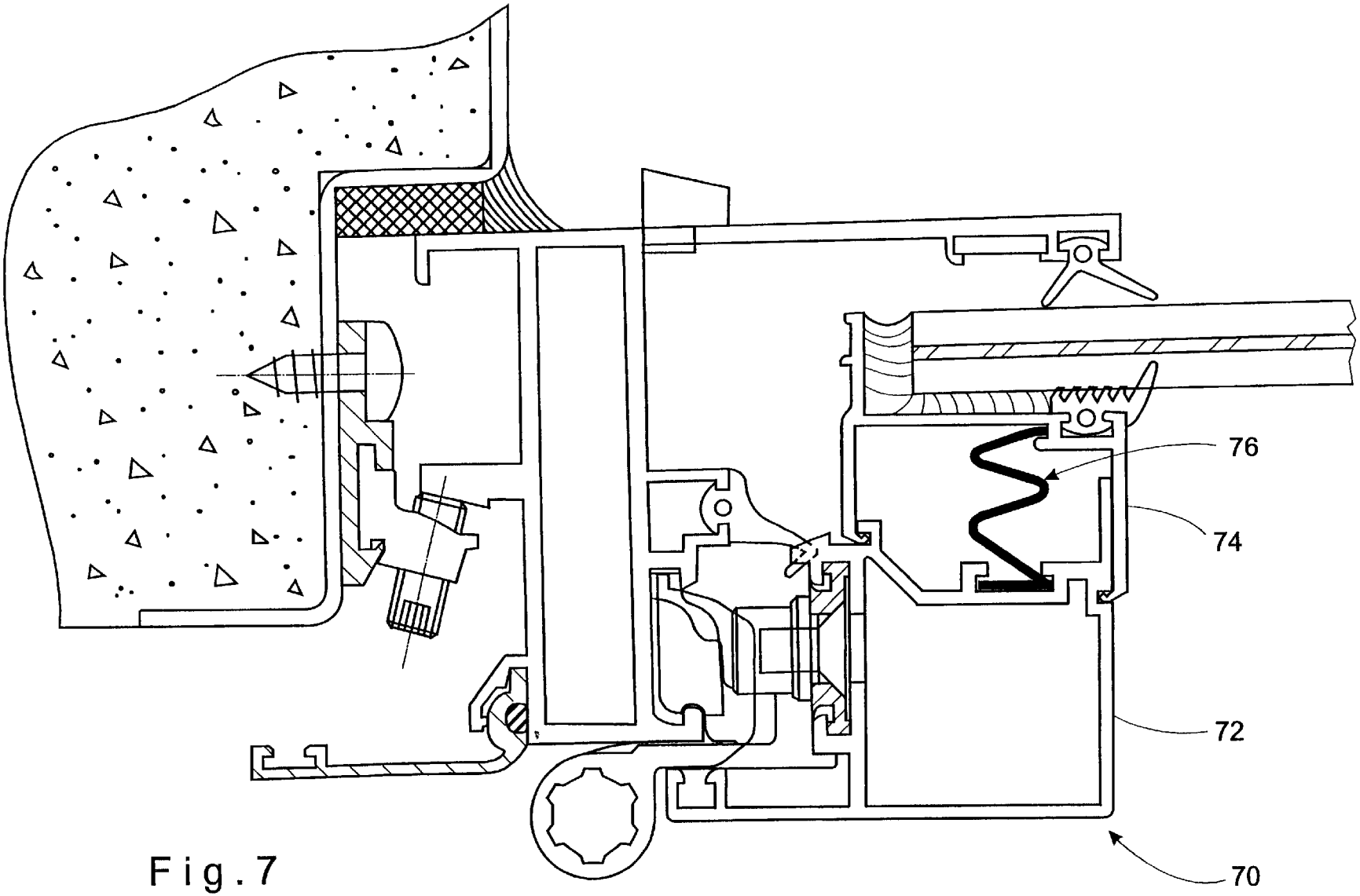

FIG. 7 is a cross-sectional view of yet another embodiment of the profiled sash member.

DETAILED DESCRIPTION OF PREFERRED EMBODIMENTS

Figure 1:
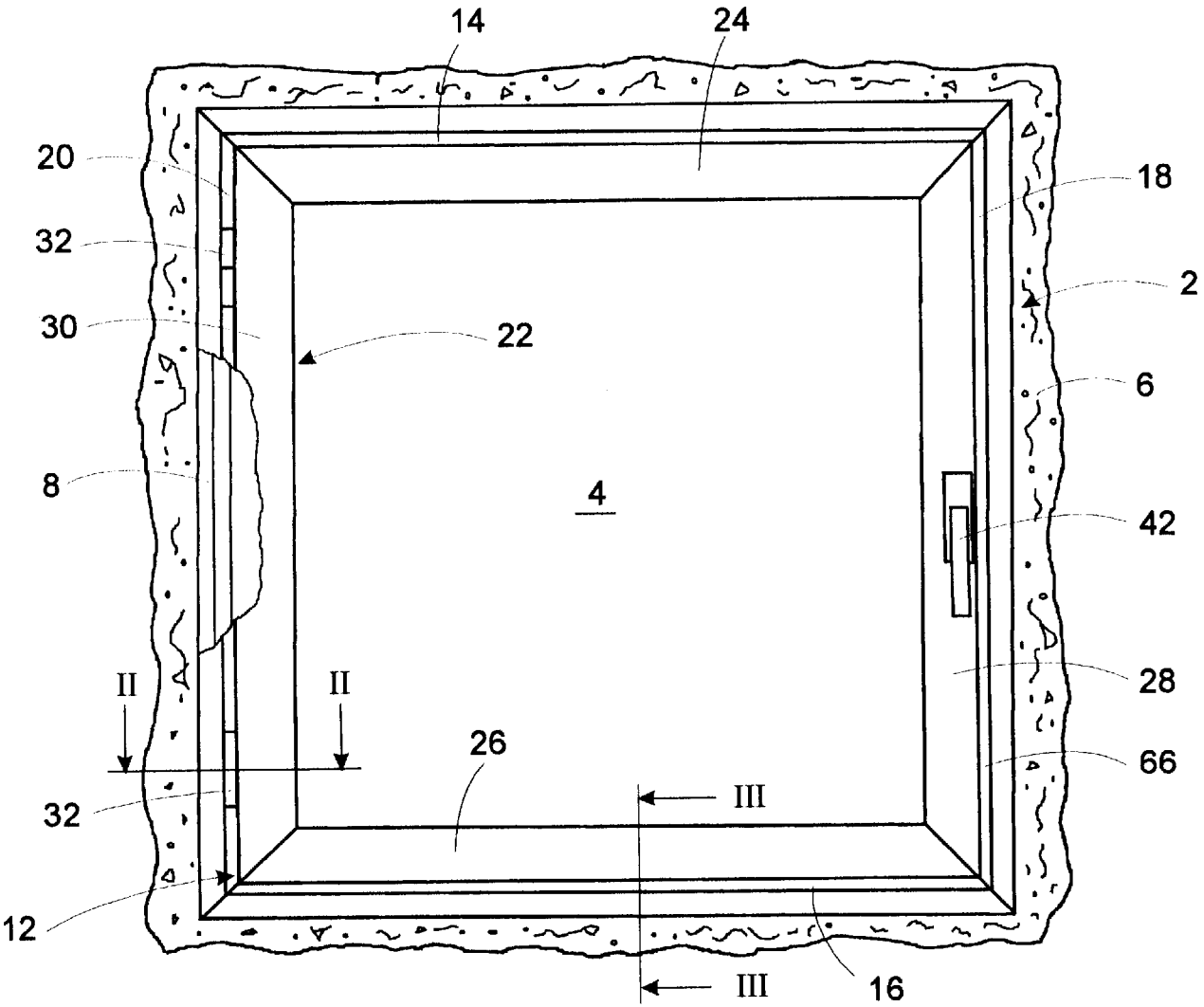
FIG. 1 is a schematic front view of a blast-resistant framework of a casement window.
Figure 2:
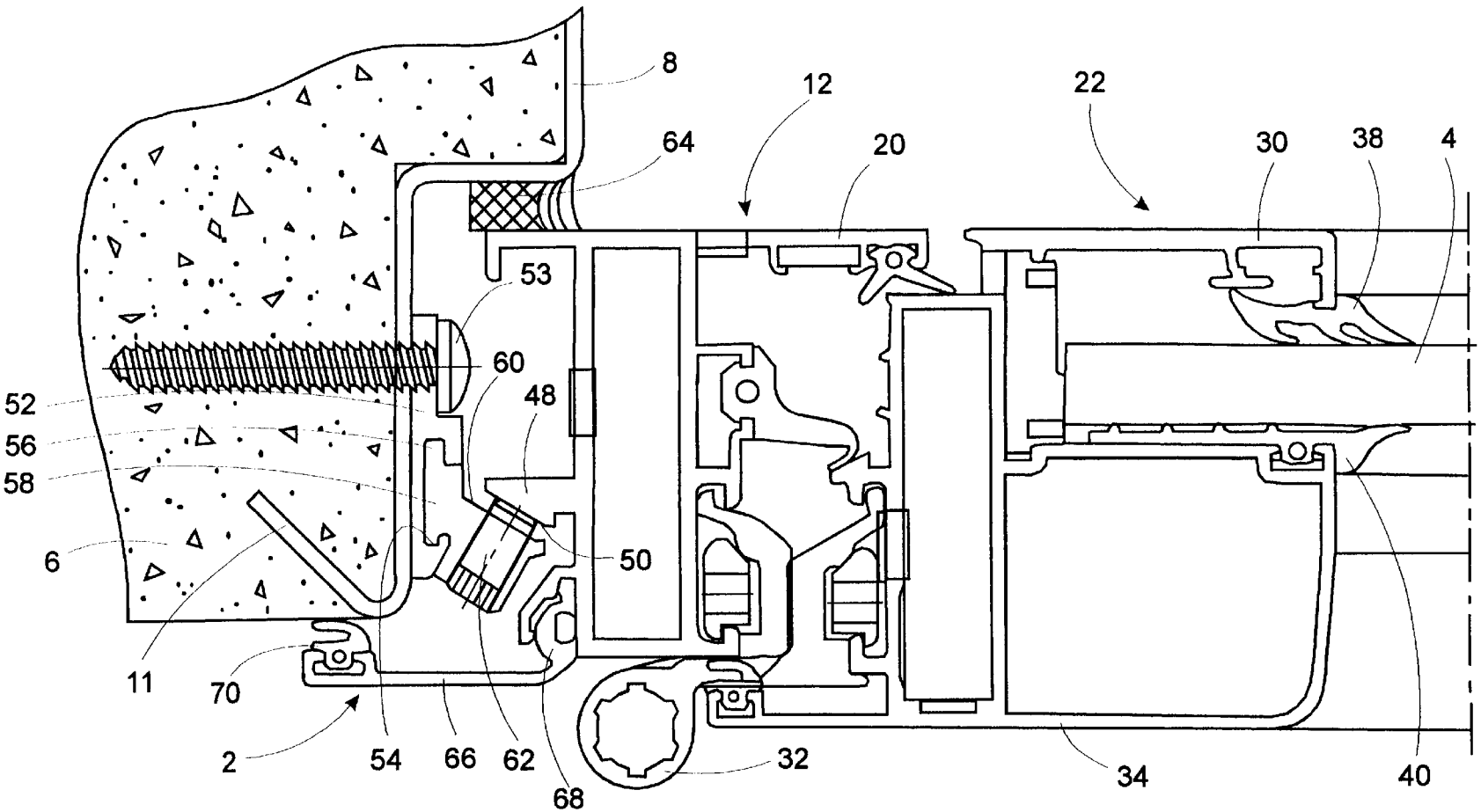
FIG. 2 is a cross-sectional view of the window framework taken along line II in FIG. 1.
Figure 3:
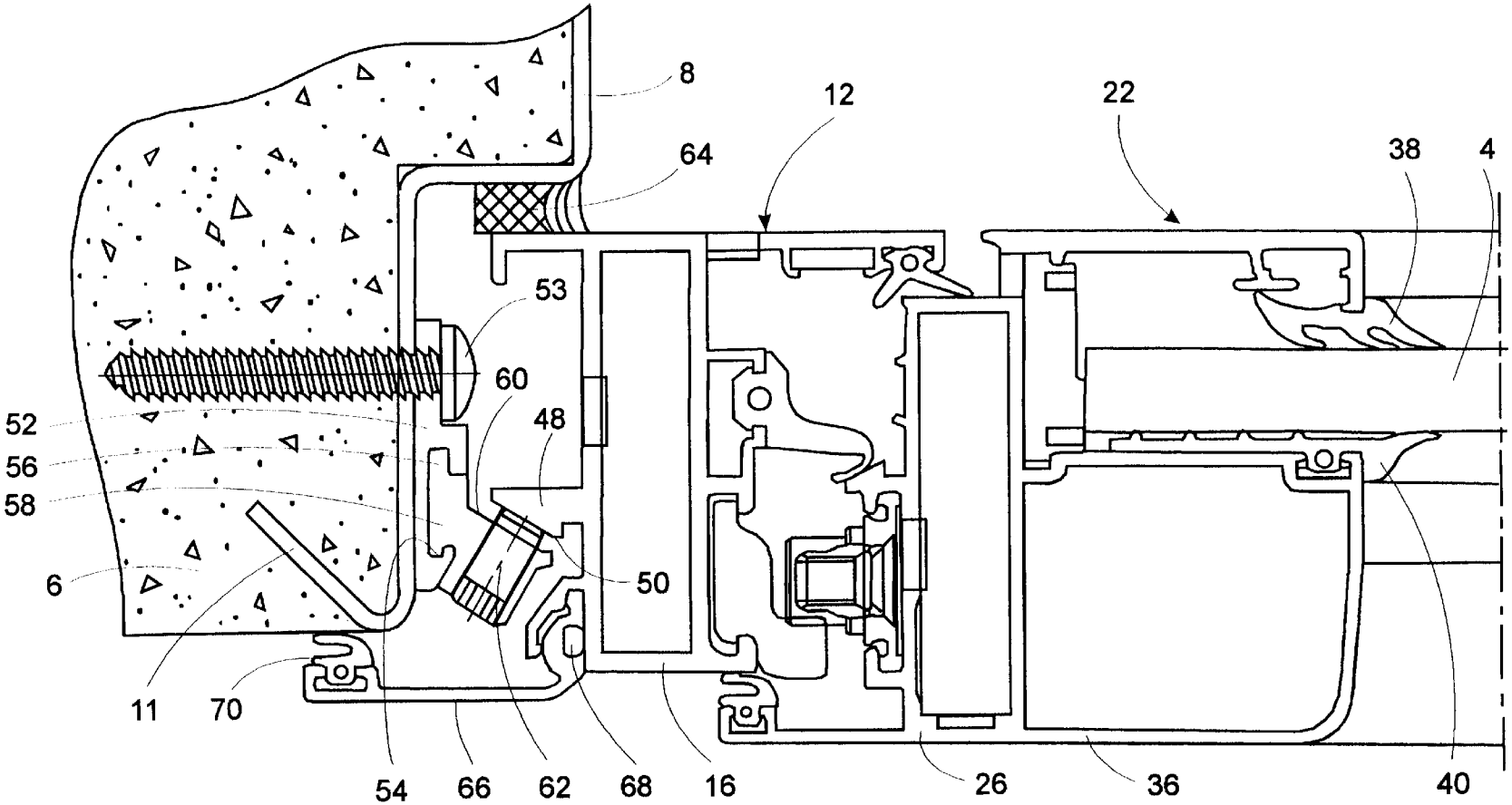
FIG. 3 is a cross-sectional view of the window framework taken along line III in FIG. 1.

FIGS. 1 to 3, which illustrate a prior art construction, have been described above in the frame of the background of the invention.

FIG. 4 illustrates a cross-sectional view of a profiled sash member 10 which constitutes a hinging stile in this particular drawing. The hinging stile 10 is shown in engagement with a side-hinging jamb 12; they are journalled one to the other via a hinge 14 and locked together by a locking unit generally marked 16. The side-hinging jamb 12 is secured to a wall 18 in a way, which is irrelevant to the present invention. The construction of the profiled hinging stile 10 is applied to the corresponding shutting stile, top rail and bottom rail of the framework (not shown) mutatis mutandis.

The hinging stile 10 comprises a main member 20 shaped as a tubular body with a generally rectangular cross-section and having a bar-like leg 21. An outer side of the main member 20 that faces the side-hinging jamb 12 is provided with a locking element 22. The stile 10 further comprises a window pane holding member 24 in which an end of a window pane 26 is rigidly and tightly secured. The shape of the window pane holding member 24 may differ from that shown in the drawing and be, for example, fork-like to hold the window pane between the fork legs. The rigid connection shown in the drawing includes an adhesive layer 28 and a resilient rubber seal 30. Owing to the reliable coupling between the window pane 26 and the holding member 24, blast pressure, if applied to the window pane, is transmitted to the profiled members of the hinged stile 10 (as well as to the other sash members of the framework, which are not shown). The hinging stile 10 also comprises a reinforcing member 32 filling the right angle formed between the main member 20 and the window pane holding member 24. Additionally, the stile comprises a damping connector 34 in the form of a bendable metal strip fitted between the windowpane holding member 24 and the main member 20. In the case that blast pressure is applied to the window pane 24, it will firstly cause bending of the damping connector 34, and thereby part of the blast pressure energy will be absorbed. As a result thereof, the full blast pressure applied to the window pane 24 will not be directly transferred to the reinforcing member 32 and main member 20, thus excessive deformation of the window sash and subsequent random unlocking of the locking units 16 will be prevented. Alternatively, or in addition to the bendable strip 43, the bar-like leg 21 may comprise a similar bendable portion, and/or the reinforcing member 32 per se may be weakened at any portion thereof to cause a similar effect.

FIG. 5 shows another embodiment of a profiled sash member. As before, a hinging stile is illustrated which is marked 40 in this drawing. Again, the construction of the profiled hinging stile. 40 also suits to the other mentioned sash members. The sash member 40 is comprised of two segments, one being an integral tubular member 42 which is a combination of a main member and a reinforcing member. One outer side of the tubular member 42 bears a locking element 44 of a locking unit 46. The second segment of the profiled sash member 40 is a window pane holding member 48 which is designed to grip the window pane 50. Two damping connectors 52 are provided between the tubular member 42 and the holding member 44, each comprising a male-female coupling unit in a semi-engaged state. In this embodiment, male elements of the damping connectors are formed integrally with the window pane holding member 48, and the female members with the combined tubular member 42. Each of the damping connectors 52 has an engaging arrangement, which is rather hard to bring into a fully engaged state. Owing to the above, either one or both of the connectors will only be coupled when a considerable pressure such as that of a blast is applied to the window pane. Structure and positioning of the damping connectors may vary; for example, at least an element of the connector may be manufactured integrally with a side wall opposing to that bearing the locking element 44.

FIG. 6 illustrates a modified version of the embodiment shown in FIG. 5. A sash section 60 is assembled from two inter-engaged segments 62 and 64. The segment 62 is a tubular combined member serving as both a main and a reinforcing member. A damping connector 66 is separately manufactured as a pair of molded male and female elements, which are respectively installed in the members 64 and 62 to be in a non-engaged state.

FIG. 7 represents yet a further embodiment of a profiled sash section 70 which is similar to that shown in FIG. 6, though differing in that a damping connector 76 is in the form of a powerful spring-like corrugated piece installed between inter-engaged segments 72 and 74 of the profiled sash section.

It has been shown that window sashes assembled from the sash sections described in the present specification stand blast pressure of about 3 Bars.

What is claimed is:

1. A profiled sash section for a window sash holding a window pane and intended for being installed in an outer frame of a blast resistant window, said sash section comprising:

a main member enabling inter-engagement between the profiled sash member and the outer frame;

a window pane holding member for accommodating and securing an end portion of said window pane in said profiled sash member;

a reinforcing member designed to support the end portion of the window pane and to transmit blast pressure, if incidentally applied to the window pane, to the main member;

said sash section being characterized in that it includes damping means for deforming up to a predetermined limit for at least partially absorbing blast pressure energy applied to the window pane.

2. The profiled sash section as in claim 1, wherein said damping means are manufactured separately and mounted in said profiled sash section.

3. The profiled sash section according to claim 1, composed of at least two inter-engaged profiled segments.

4. The profiled sash section according to claim 1, selected from a list comprising a hinging stile, a shutting stile, a top rail and a bottom rail.

5. The profiled sash section as in claim 1, wherein the main member is a bar-like body serving to accommodate locking elements, hinges.

6. The profiled sash section according to claim 1, wherein the reinforcing member forms a tubular body.

7. The profiled sash member according to claim 1, wherein said reinforcing member fills a corner formed between said main member and a plane of the window pane.

8. The profiled sash section according to claim 1, wherein said reinforcing member is an integral part of said main member which form together a tubular body.

9. The profiled sash section according to claim 1, wherein said damping means comprise at least one damping connector provided between at least one of the following three pairs: the reinforcing member and the window pane holding member, the reinforcing member and the main member, the main member and the window pane holding member.

10. A blast-resistant framework for a casement window, said framework comprising a window sash assembled from the profiled sash sections according to claim 1; the window sash being adapted for rigidly and air-tightly securing the window pane in the holding members of said profiled sash members.

* * * * *